US005196075A

United States Patent [19]

Jansen et al.

[11] Patent Number: 5,196,075

[45] Date of Patent: Mar. 23, 1993

[54] METHOD FOR MODIFYING AND THEREBY IMPROVING THE CORROSION RESISTANCE AND HARDNESS OF WORKPIECES OF FERRITIC STEEL

[75] Inventors: Knut Jansen, Mülheim; Andreas Franziskus; Hans J. Plümer, both of Hemer, all of Fed. Rep. of Germany

[73] Assignee: ITW-ATECO GmbH, Norderstedt, Fed. Rep. of Germany

[21] Appl. No.: 825,736

[22] Filed: Jan. 27, 1992

Related U.S. Application Data

[63] Continuation of Ser. No. 385,126, Jul. 26, 1989, abandoned.

[51] Int. Cl.[5] ..... C21D 9/00

[52] U.S. Cl. ..... 148/530; 148/518; 148/529

[58] Field of Search ..... 148/12 EA, 12.1, 530, 148/529, 518; 204/37.1, 23

[56] References Cited

U.S. PATENT DOCUMENTS

| | | | |
|---|---|---|---|
| 3,067,072 | 12/1962 | Leffingwell et al. | 148/12 EA |
| 4,013,488 | 3/1977 | Ramqvist et al. | 204/37.1 |
| 4,411,934 | 10/1983 | Steinhagen | 204/23 |

FOREIGN PATENT DOCUMENTS

| | | |
|---|---|---|
| 54-048650 | 4/1979 | Japan . |
| 57-108289 | 7/1982 | Japan . |
| 59-140389 | 8/1984 | Japan . |

*Primary Examiner*—Deborah Yee
*Attorney, Agent, or Firm*—Schwartz & Weinrieb

[57] ABSTRACT

The invention relates to a method for making workpieces of ferritic steel, such as drilling screws wherein the workpiece is made of a transformable chrome steel having a chrome percentage of at least 13%, whereupon a workpiece receives a coating from nickel or a nickel or cobald alloy having a thickness of at least 5 μm, and subsequently the workpiece is heat treated under oxygen free environment at at least 850° C. so as to obtain a desired hardness and corrosion resistance.

19 Claims, No Drawings

METHOD FOR MODIFYING AND THEREBY IMPROVING THE CORROSION RESISTANCE AND HARDNESS OF WORKPIECES OF FERRITIC STEEL

This application is a continuation of application Ser. No. 385,126, filed Jul. 26, 1989 now abandoned.

FIELD OF THE INVENTION

The present invention relates to a method from making workpieces of ferritic steel.

BACKGROUND OF THE INVENTION

In a wide variety of applications workpieces should possess a degree of high hardness and a degree of wear resistance. A further required characteristic is corrosion resistance. For these applications carbon steel is not suitable since this material is particularly sensitive a corrosive environment. It is thus known to use rust resistent alloyed steels containing for example chrome, nickel, cobalt, molybdenum and similar components. These alloyed steels regularly possess a relatively slow susceptibility to corrosion and allow one gramma to obtain a steel with the desired hardness due to their hardenability. However, chrome steel for example is unsuitable for making fasteners for constructional applications such as, for example for making screw fasteners, in particular drilling screws. The reason for this is fissuring induced means of hydrogen (hydrogen embrittlement). Under continuous static load forces over impressed upon the fasteners. a long period of time the hydrogen originally contained within the fastener results in fissuring. The same effect is caused by means of hydrogen which acts from upon the fastener, before "for" insert—from a position external to the fastener, such as, for example within a cathodic reaction under corrosion processes. This severely reduces the fatigue strength of a screw for example thereby jeopardizing the safety of a construction site or structure. It might be considered to thermically expel the hydrogen contained within the workpiece and to provide a protective layer by coating the workpiece, such as for example by means of a zinc plating which serves as a barrier to the hydrogen. There is, however, the danger that the protective layer may be damaged during use or, alternatively, cannot completely prevent cracking so that in turn hydrogen embrittlement cannot be fully prevented.

OBJECT OF THE INVENTION

It is an object of the present invention to provide a method for making workpieces of ferritic steel in which the workpieces exhibit a high degree of hardness and strength together with a high degree of corrosion resistance which approaches the corrosion resistance of austenitic chrome nickel steels and in which fissuring induced by means of hydrogen is prevented.

SUMMARY OF THE INVENTION

The present invention provides for a method for making workpieces of ferritic steel comprising the steps of forming a workpiece of a transformable chrome steel having a chrome percentage of at least 13%, coating the workpiece with a layer of nickel or an alloy containing substantially nickel or cobalt, the layer having a thickness of at least 5 μm, diffusion annealing the workpiece at at least 850° C. under the an oxygen free environment so as to produce a degree of corrosion resistance within or beneath the nickel or colbalt alloyed layer as a result of the formation of an austenitic alloyed layer.

DETAILED DESCRIPTION OF THE INVENTION

According to the invention the workpiece is made from a transformable chrome steel having a chrome percentage of at least 13%. As mentioned before workpieces made of chrome steel are known. However, according to the invention the workpiece is coated with a layer of nickel or an alloy substantially made of nickel or cobalt having a thickness of at least 5 μm. Thereafter, the workpiece is heat treated at at least 850° C. under an oxygen free environment so as to develop the desired degree of hardness, and wherein the diffusion layer of the coating and basic material and having the particular characteristics, is formed. According to the invention the workpieces thus treated provide for a nickel envelope with a chrome nickel iron layer of varying composition below. As a result of the heat treatment any existing hydrogen is expelled. Hydrogen, for example, being generated under corrosion conditions cannot penetrate the chrome nickel iron diffusion layer. It is substantial to the invention that the core of the workpiece consists of a high-grade transformable steel, and furthermore that by diffusing nickel into the chrome steel or vice versa, chrome into the nickel layer an austenitic intermediate layer of relatively high thickness results which is a strong barrier against the penetration of hydrogen. According to the invention no hardness producing components must diffuse the nickel layer in order to obtain the capability of the workpiece in use. Hardening and generation of the corrosion resistance takes place during a single step due to the chrome containing and possibly molybdenum containing austenitic coatings over a material of inherent low corrosion. Should the chrome steel contain molybdenum according to an embodiment of the invention, the percentage of molybdenum within the austenitic intermediate layer is of advantage for repassivation.

According to the invention only a single layer is required in order to obtain the desired corrosion resistance and to prevent the hydrogen induced cracking.

According to an embodiment of the invention the nickel layer or, respectively the coating of a nickel or cobalt containing alloy is additionally coated with a layer of chrome, cobalt, molybdenum or copper having a thickness of at least 2 μm. During the subsequent diffusion annealing an austenitic chrome nickel iron layer is formed upon the chrome steel which layer core which changes to martensitic chrome steel with no transition.

In contrast to known fasteners made of nontransformable austenitic rust and acid resistent steels in order to improve the corrosion resistance properties thereof, the method according to the invention permits one to make workpieces of approximately equally good corrosion resistance and of the desired hardness.

According to an alternative method of the invention the workpiece is formed from a nickel or molybdenum containing steel, and the process further includes the steps of thereafter coating the workpiece with a chrome layer having a thickness of at least 5 μm and then heat treating the workpiece at at least 850° C. under the an oxygen free environment so as to bring the workpiece to the desired hardness. According to this method a similar corrosion resistant protective layer is obtained as specified above.

According to the method of the invention, additional corrosive protection by means of zinc plating or cadmium plating is eliminated. However, additional layers in order to improve sliding or frictionless conditions may be applied. Instead of layers made of organic material, metallic coatings may be considered.

The method of the invention may be applied to a variety of heavy duty workpieces, such as for example, knife blades, chirurgical instruments and other high wear resistant tools and elements. The method is particularly useful for making fasteners such as for example screws, in particular drilling screws for construction where a high degree of corrosion resistance and a high degree of hardness is required for reasons of safety. For example the hardness is necessary for drilling screws in order to drill a bore within relatively hard material.

German patent publication 24 18 908 teaches a method for increasing the corrosion resistance of steel pieces, such as, for example heating rod tubes, lye containers, drums for washing, drying and centrifugal machines or pieces upon a steel base where the pieces receive a nickel coating between 5 to 10 μm thick within a nickel bath. Thereafter the steel pieces are annealed at 800° to 1000° C. within an oxidizing atmosphere. A nickel oxide coating results thereby exhibiting a certain temperature and corrosion resistance. However, hydrogen induced fissuring may not be prevented in this manner. Furthermore, the pieces made by means of this method do not exhibit the hardness required for a drilling screw, for example.

In accordance with the following, a number of examples are specified which note the materials used in accordance with the method of the present invention.

Chrome steel:

Material according to DIN 17006: 1.1% carbon; 15% chrome; % molybdenum.

Material No. 4112 according to DIN 17006: 0.9% carbon; 18% chrome; % molybdenum

A drilling screw, for example made of chrome steel identified above is galvanically plated with a nickel layer having a thickness of 10 μm or a layer of nickel having a thickness of 5 μm and chrome approximately 2 μm thick.

Plating conditions for the nickel layer:

| | |
|---|---|
| temperature | 50 to 70° C. |
| ph: | 6 to 3 |
| current density: | 2 to 9 A/d $cm^2$ |
| nickel bath: | |
| nickel sulfate | 300 g/l |
| nickel chloride: | 40 g/l |
| nickel boric acid: | 40 g/l |

Plating conditions for the chrome layer:

| | |
|---|---|
| temperature: | 55° C. |
| current density: | 40 A/d $cm^2$ |
| chrome bath: | |
| chromic acid: $CrO_3$ | 350 g/l |
| sulphuric acid: density 1.84 | 2.5 g/l |

Of course, the plating may be produced by methods other than that noted hereinabove The heat treatment is performed within a furnace under an oxygen-free environment at a temperature of for example 1000° C. for a time of 10 minutes. The temperature depends upon the basic material used and the time depends upon the hardness to be obtained.

It is useful to quench the pieces after the heat treatment corresponding to their percentage of basic carbon in order to obtain a martensitic hardness structure. Subsequently the pieces are adjusted to the hardness desired by tempering, such as for example to temperatures between 100° and 700° C.

Obviously, many modifications and variations of the present invention are possible in light of the above teachings. It is therefore to be understood that within the scope of the appended claims, the present invention may be practiced otherwise than as specifically described herein.

We claim:

1. A method for modifying and thereby improving the corrosion resistance and hardness of workpieces of ferritic steel, comprising the steps of:

forming a workpiece core from a ferritic chrome steel having a chrome percentage by weight of at least 13%;

providing said workpiece core with an outer layer of nickel, said outer layer having a thickness of at least 5 μm; and diffusion annealing said workpiece under an oxygen-free environment a at at least 850° C. so as to form an intermediate austenitic chrome-nickel alloyed layer between said chrome steel core and said outer layer of nickel which provides said workpiece with a desired corrosion resistance while said chrome steel core is changed from ferritic chrome steel to martensitic chrome steel which provides said workpiece with a desired degree of hardness.

2. A method for modifying and thereby improving the corrosion resistance and hardness of workpieces of ferritic steel, comprising the steps of:

forming a workpiece core from a ferritic steel containing a percentage of nickel or molybdenum;

providing said workpiece core with an outer layer of chrome having a thickness of at least 5 μm; and diffusion annealing said workpiece under an oxygen-free environment at at least 850° C. so as to form an intermediate austenitic nickel-chrome or molybdenum-chrome alloyed layer between said nickel or molybdenum steel core and said outer layer of chrome which provides said workpiece with a desired degree of corrosion resistance while said nickel or molybdenum steel core is changed from ferritic nickel or molybdenum steel to martensitic nickel or molybdenum steel which provides said workpiece with a desired degree of hardness.

3. The method of claim 1, wherein the chrome steel contains molybdenum.

4. The method of claim 1, wherein the nickel layer is coated by a layer of chrome, cobalt, molybdenum or copper having a thickness of at least 2 μm.

5. The method of claim 1, wherein said workpieces comprise fasteners.

6. A method as set forth in claim 5, wherein:

said fasteners comprise screws.

7. A method as set forth in claim 6, wherein:

said screws comprise drilling screws.

8. A method for modifying and thereby improving the corrosion resistance and hardness of workpieces of ferritic steel, comprising the steps of:

forming a workpiece core from a ferritic chrome steel having a chrome percentage by weight of at least 13%;

providing said workpiece core with an outer layer of a nickel alloy having a thickness of at least 5 μm; and diffusion annealing said workpiece under an oxygen-free environment at at least 850° C. so as to form an intermediate austenitic chrome-nickel alloyed layer between said chrome steel core and said outer layer of said nickel alloy which provides said workpiece with a desired corrosion resistance while said chrome steel core is changed from ferritic chrome steel to martensitic chrome steel which provides said workpiece with a desired degree of hardness.

9. The method as set forth in claim 8, wherein:

said chrome steel contains molybdenum.

10. The method as set forth in claim 8, wherein:

said nickel alloy layer is coated with a layer of chrome, cobalt, molybdenum, or copper having a thickness of at least 2 μm.

11. The method as set forth in claim 8, wherein:

said workpiece comprises a fastener.

12. The method as set forth in claim 11, wherein:

said fastener comprises a screw.

13. The method as set forth in claim 12, wherein:

said screw comprises a drilling screw.

14. A method for modifying and thereby improving the corrosion resistance and hardness of workpieces of ferritic steel, comprising the steps of:

forming a workpiece core from a ferritic chrome steel having a chrome percentage by weight of at least 13%;

providing said workpiece core with an outer layer of a cobalt alloy having a thickness of at least 5 μm; and diffusion annealing said workpiece under an oxygen-free environment at at least 850° C. so as to form an intermediate austenitic chrome-cobalt alloyed layer between said chrome steel core and said outer layer of said cobalt alloy which provides said workpiece with a desired corrosion resistance while said chrome steel core is changed from ferritic chrome steel to martensitic chrome steel which provides said workpiece with a desired degree of hardness.

15. The method as set forth in claim 14, wherein:

said chrome steel contains molybdenum.

16. The method as set forth in claim 14, wherein:

said cobalt alloy layer is coated with a layer of chrome, cobalt, molybdenum, or copper having a thickness of at least 2 μm.

17. The method as set forth in claim 14, wherein:

said workpiece comprises a fastener.

18. The method as set forth in claim 17, wherein:

said fastener comprises a screw.

19. The method as set forth in claim 18, wherein:

said screw comprises a drilling screw.

* * * * *